United States Patent [19]

Gommans

[11] 4,039,743

[45] Aug. 2, 1977

[54] STRANDED WIRE WITH ADHESIVE COATED CONE

[75] Inventor: Hubertus Johannes Josephus Gommans, Venlo, Netherlands

[73] Assignee: U.S. Philips Corporation, New York, N.Y.

[21] Appl. No.: 584,331

[22] Filed: June 6, 1975

[30] Foreign Application Priority Data

June 27, 1974 Netherlands ..... 7408651

[51] Int. Cl.[2] ..... H01B 11/02

[52] U.S. Cl. ..... 174/114 R; 174/110 R; 174/113 C; 174/128 R; 174/131 R

[58] Field of Search ..... 174/114 R, 128 R, 131 R, 174/131 A, 113 C, 115, 110 R; 57/149; 224/253, 254

[56] References Cited

U.S. PATENT DOCUMENTS

| | | | |
|---|---|---|---|
| 1,211,153 | 1/1917 | Hochstadster | 174/115 |
| 2,066,525 | 1/1937 | Gilbert | 174/128 R |
| 2,427,507 | 9/1947 | Powell | 174/128 R |
| 3,131,469 | 5/1964 | Glaze | 171/128 R |
| 3,710,008 | 1/1973 | Sawyer | 174/131 A |

*Primary Examiner*—E. A. Goldberg

*Attorney, Agent, or Firm*—Frank R. Trifari; David R. Treacy

[57] ABSTRACT

Stranded wire comprising a plurality of individual strands twisted around a core coated with a thin layer of adhesive (a synthetic material or solder). During manufacture of the wire or of lengths of wire the individual strands are joined to the core either throughout the entire length or locally so that when the insulation sheath is locally removed the wire strands cannot fan out.

1 Claim, 1 Drawing Figure

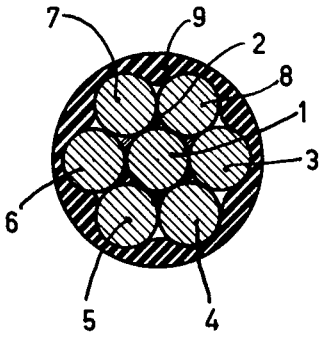
7
9
2
8
1
3
6
5
4

STRANDED WIRE WITH ADHESIVE COATED CONE

BACKGROUND OF THE INVENTION

1. Field of the Invention

The invention relates to a stranded wire composed of a plurality of metal strand wires twisted together. The wires may be joined to one another throughout their entire length or locally, or may be joined together only when the stranded wire is to be used. The wire may be provided with an insulating sheath. In general stranded wire has better flexibility and resistance to repeated bending than a single-wire conductor of the same electrically effective metal diameter.

Connecting a stranded wire by a soldered or crimped connection frequently proves difficult in practice, because the individual strands fan out after the wire has been cut to the required length and the insulating sheath has been removed.

2. Description of the Invention

According to one known practice, an additional operation is required in which the individual strands, which have been bared on removal of the insulating sheath, are again twisted together. This operation is generally followed by the provision of solder metal to the wire ends so as to join them to form a single unit. Such operations involve relatively high labor costs and adversely affect the bending strength of the wire at the location of the soldering. Moreover the amount of solder applied in general is large and undefined; hence when using a crimped connection the electrical contact is likely to be unstable, because the solder will flow under the pressure used for crimping.

Stranded wires are known which are made by twisting together metal strands coated with solder throughout their length. In these wires the solder coating has a thickness such that, when manufacturing stranded wire lengths by cutting a larger length into pieces, the twisted strands can be joined together by local heating. This may be effected, for example, by joining the individual strands to one another by induction heating at the locations at which the insulation is to be removed. Stranded wires used for this purpose have the disadvantage that each individual strand is provided with a comparatively thick solder coating. The provision of a solder of the required thickness and the amount of solder concerned cause the price of such wire to be comparatively high.

Stranded wires are also known in which, during manufacture, individual metal wires are joined together throughout their length by solder. An advantage of such wire is that the solder can be applied after the bare strands have been twisted together so that at least one operation is dispensed with. A disadvantage is that part of the flexibility is lost. Another disadvantage is the comparatively large use of solder and the poor reproducibility of the process. However, the stranded wire still has a considerably higher resistance to repeated bending than a solid conductor of equal diameter.

It is also known to manufacture wire for underwater cables by coating a central wire, by means of an extrusion process, with an insulating mantle consisting of polyethylene or a copolymer thereof which contains a hardener, such as an organic peroxide. The thickness of such an insulating mantle is about 100 μm. A plurality of wires is twisted around the insulated wire and the assembly is provided with an outer sheath of polyethylene or a copolymer thereof which also contains a hardener. Finally the resulting wire is hardened at increased temperature and pressure. During this process the initial interstices between the wires are entirely filled with polyethylene whilst the insulating mantle and the outer sheath are firmly bonded to one another by cross-linking.

A disadvantage of this known method is that the cable obtained is solid and its flexibility is reduced.

SUMMARY OF THE INVENTION

The object of the present invention to provide a stranded wire in which a plurality of wires are twisted around a core which consists of at least one wire, which is economical to manufacture, has good flexibility, and is easy to terminate.

According to the invention a wire core is provided with thin layer of an adhesive, containing a solder metal or a plastic synthetic material. The thickness of the layer is from about 1 to 20 μm , and preferably from 1–10 μm.

When the thin layer consists of a solder metal it may be applied by passing the core through a bath of molten solder and subsequently removing the excess solder in a usual manner by means of a drawing die. A thin layer of plastic synthetic material can be applied by passing the core along a roller provided with a layer of an absorbing material, such as felt, in which a solution of the synthetic material in an organic solvent is absorbed. The application of adhesive is effected at a fast rate. This offers a considerable advantage as compared with the aforementioned prior art in which the core was provided with a covering of polyethylene containing a hardener by means of a far slower extrusion process.

According to the invention the individual strands twisted around the core may be attached to the core throughout the entire length of the wire or only locally, or not attached.

According to another aspect of the invention, in a method of manufacturing stranded wire after twisting of the strands around the core the assembly is passed through a zone in which the temperature is so high that the adhesive layer softens and adheres to the metal wires. For this purpose the assembly may be passed through a furnace. As an alternative, heating may be effected by a direct passage of current or by means of a high-frequency field.

In a preferred embodiment of the method an adhesive layer is used which has a composition such that the heat evolved during the provision of an insulating sheath of a synthetic material around the wire is sufficient to cuse the adhesive layer to adhere.

Because of the small thickness of the adhesive layer in stranded wire according to the invention, in the process in which the core and the individual strands twisted around it are bonded together the interstices between the strands are filled with the solder metal or with the plastic synthetic material for a small part only. As a result the wire remains flexible even if the core is bound by the adhesive layer to the individual strands twisted around the core throughout the entire length of the wire. When a plastic synthetic material is used in the adhesive layer, the flexibility of the wire is enhanced owing to the plasticity of the synthetic material.

The flexibility of stranded wire is still further improved if the individual strands are only locally attached or adhered to the core. At the adhered areas the desired electrical connections can be established by the user afterwards. A wire of this type is manufactured by rapidly cooling the insulating sheath during extrusion, so that adherence of the metal strands throughout the entire length of the wire is prevented, and subsequently heating the wire at the desired locations, for example by means of a high-frequency induction field.

In yet another embodiment of the invention which is highly suitable for practical use, the core is not adhered to the individual strands twisted around it. The user of the wire must join the core to the strands by heating at the desired locations. Such a wire is obtained by the process described in the preceding paragraph, but omitting the heating step.

In addition to higher flexibility, saving in material and a cheaper and faster method of manufacturing, the litz wire according to the invention provides the advantage that the adhesive can be a material having so low a softening point that insulating materials of low softening temperature can be used. This is of advantage, for example, in cables for high-frequency signal transmission in which polyethylene insulation is used because of its low dielectric losses. The melting point of polyethylene, however, does not exceed about 100° C.

BRIEF DESCRIPTION OF THE DRAWING

The invention will now be described in more detail with reference to the accompanying diagrammatic drawing the single FIGURE of which is a cross-sectional view of a stranded wire embodiment of the invention, and to the following Examples.

DESCRIPTION OF THE PREFERRED EMBODIMENTS

The FIGURE shows a central wire 1 which acts as a core for the stranded wire. The wire 1, which for example consists of copper, is provided with an adhesive coating 2. 6 wire strands 3 to 8 are twisted around the core wire 1 with a lay generally used for stranded wire. The assembly is surrounded by an insulating sheath 9 made of a synthetic material. Very good results are obtained when the thin layer of the adhesive contains a synthetic material selected from the group comprising polyamide, polyvinyl butyral, epoxy resin and phenoxy resin. Preferably the synthetic materials have a softening range between about 80° C and about 200° C. Suitable solvents for these plastic synthetic materials are, for example, aliphatic and aromatic hydrocarbons, ethers, alcohols, ketones, esters, such as ethyl acetate, xylene, butanol, ethyl butyl ketone. The strands 3–8 twisted around the core may be bare or covered with a thin layer of a metal, such as tin, which serves only to facilitate soldering to the wire but is insufficient to fill the interstices between the strands. If the core comprises more than one wire, the adhesive layer may be provided on each individual core wire before twisting or on the wire collectively after twisting. The strands twisted around the core may have a diameter equal to or different from, for example smaller than, that of the core. A stranded wire according to the invention in its simplest form comprises seven individual strands of substantially equal diameters, six of which are regularly twisted around a central strand coated with an adhesive layer and serving as the core 1.

EXAMPLE I

A core strand 1 of copper of diameter 160 μm is covered with a coating of solder 2 composed of about 60% by weight of lead and about 40% by weight of tin and having a thickness of about 2 μm. The strands 3 to 8 of copper of the same diameter are each covered with a thin coating of tin of 0.2 μm. The lay with which the strands 3 to 8 are twisted around the core 1 is about 10 mm.

The insulating sheath 9 consists of polyvinyl chloride. The overall outer diameter is about 2 mm. The strands 3 to 8 may be locally joined to the central wire 1 in that they are briefly heated locally to 300° C by means of a high-frequency inductive field. When the insulation is removed at the location at which the wires are joined together, the strands of the wire do not fan out. When a crimped connection is used a permanent electrical contact of high quality is obtained.

EXAMPLE II

Around a central conductor 1 of copper, having a diameter of 160 μm and provided with a coating which is about 5 μm thick and consisting of polyvinyl butyral which has a softening range of from about 80° C to about 150° C, 6 bare copper strands 3 to 8 also of diameter 160 μm are twisted with a lay of about 10 mm. A sheath 9 of polyethylene is extruded around the twisted wires at a temperature between 180° C and 200° C. The heat liberated from the sheath is sufficient to cause the polyvinylbutyral coating 2 to adhere to the strands 3 to 8. In this embodiment the strands 3 to 8 are joined throughout their length to the central conductor 1 which acts as the core wire. When the insulating sheath 9 is removed the indivudual strands of the wire do not fan out, while when a crimped connection is used a permanent electrical contact of high quality is obtained.

EXAMPLE III

Around a central conductor 1 of copper, having a diameter of 160 μm and provided with a coating 2 having a thickness of about 5 μm and consisting of an epoxy resin which has a softening range from about 100° C to about 180° C, 6 tinned copper strands which also each have a diameter of 160 μm are twisted with a lay of about 10 mm. A sheath 9 of polyvinyl chloride is extruded around the twisted strands at a softening temperature of about 170° C. During this process the sheath is rapidly cooled, by passing the wire through water immediately after the provision of the sheath. As a result, no adherence between the strands is produced. When the wire is cut into lengths and the insulating sheath 9 is removed from the ends thereof, these ends are passed through a high-frequency inductive field so that the wire is briefly heated to a temperature of about 250° C. Consequently the individual strands do not fan out at the ends and hence it can safely and economically be used for making a soldered or crimped joint.

What is claimed is:

1. A stranded wire comprising a wire core, a plurality of individual wire strands twisted around the wire core, a sheath formed of a plastic synthetic material extruded around the wire strands twisted around the wire core, and a thin coating of adhesive material continuously along the length of the wire core having a thickness insufficient to fill interstices between said individual wire strands and adhering individual wire strands to the wire core, wherein the individual wire strands are adhered to the wire core only at local areas and not continuously along the length of the wire core.

* * * * *

UNITED STATES PATENT AND TRADEMARK OFFICE

CERTIFICATE OF CORRECTION

PATENT NO. : 4039743

DATED : Aug. 2, 1977

INVENTOR(S) : HUBERTUS JOHANNES JOSEPHUS GOMMANS

It is certified that error appears in the above-identified patent and that said Letters Patent are hereby corrected as shown below:

In the Title:

"Stranded Wire With Adhesive Coated Cone" should read --Stranded Wire With Adhesive Coated Core--

Column 2, line 31, after "advantage" insert --of speed--

Column 3, line 15, delete "the litz" and insert --stranded--

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*